US007179008B2

(12) United States Patent
Holcomb

(10) Patent No.: US 7,179,008 B2
(45) Date of Patent: Feb. 20, 2007

(54) APPLICATOR PEN

(75) Inventor: David Lee Holcomb, Charlotte, NC (US)

(73) Assignee: David L. Holcomb, Charlotte, NC (US)

( * ) Notice: Subject to any disclaimer, the term of this patent is extended or adjusted under 35 U.S.C. 154(b) by 0 days.

(21) Appl. No.: 10/453,837

(22) Filed: Aug. 29, 2003

(65) Prior Publication Data

US 2005/0047847 A1 Mar. 3, 2005

(51) Int. Cl.
*B43K 7/02* (2006.01)
*B43K 23/08* (2006.01)

(52) U.S. Cl. ..... 401/217; 401/209; 401/213

(58) Field of Classification Search ..... 401/208–217
See application file for complete search history.

(56) References Cited

U.S. PATENT DOCUMENTS

| | | | | |
|---|---|---|---|---|
| 3,523,628 | A * | 8/1970 | Colvin | 222/107 |
| 5,433,782 | A * | 7/1995 | Filbert et al. | 118/266 |
| 5,716,151 | A * | 2/1998 | Satake | 401/188 A |
| 5,743,401 | A * | 4/1998 | Takahashi | 206/447 |
| 5,915,872 | A * | 6/1999 | Machida et al. | 401/251 |
| 5,938,357 | A * | 8/1999 | Faraj | 401/18 |

* cited by examiner

*Primary Examiner*—David J. Walczak

(57) ABSTRACT

A device for applying liquid adhesive to seal a variety of parcel post items such as, containers, packages, boxes, envelopes and stamps. The device includes a hand-held pen-shaped housing having a roller ball therein for dispensing the adhesive. The device further includes a vent and a drain hole in the housing.

3 Claims, 2 Drawing Sheets

APPLICATOR PEN

BACKGROUND

This version of the invention is concerned with the field of devices that store and dispense liquid solutions and adhesives for sealing a variety of items. More specifically, this version of the invention is concerned with an applicator device or pen fabricated into the shape of a conventional writing pen, said device or pen designed to store and dispense liquid solutions and adhesives from a roller ball as the applicator device or pen is used in the manner of a writing pen.

PRIOR ART

A variety of devices and methods are available for applying liquid adhesives and other sealing, binding, or aqueous solutions to seal a variety of parcel post items, containers, and packages; boxes; envelopes; stamps; and the like. A popular means of dispensing liquid adhesives or other solutions involves the use of a hand-held, pen-shaped device that is constructed with a hollow container that functions to store a reserve of liquid adhesive or solution and to provide the means for grasping and manipulating the device as necessary for applying the adhesive or solution. The container is also constructed with a tip or head member through which adhesive or solution is dispensed onto a surface, albeit in a controlled and confined manner. Although these devices function at varying degrees of success to dispense and apply liquid adhesives and other solutions, they suffer from several disadvantages and shortcomings. In some devices, for instance, the tip or head member is fabricated into a shape and size that makes it difficult to apply liquid adhesive or solution in a precise or confined area as required for stamps or certain types of envelopes. In other devices, the tip or head member is constructed of a rectangular sponge or similar absorbing material, which frequently becomes clogged or obstructed with debris and dried adhesive.

What is needed then to overcome the aforementioned disadvantages of hand-held devices that store and dispense liquid adhesive and other solutions is the provision of an applicator pen that is constructed with means that applies liquid adhesive and the like onto an envelope, package, and stamp, if necessary, in a controlled and precise manner in order to ensure adequate sealing and efficient use of the adhesive and solution with a minimum amount of waste. Such a means of application would include a rotating ball disposed within one end of such a device that communicates simultaneously with a reservoir of liquid adhesive or solution and the surface of a package, envelope, or other item.

DISCUSSION OF THE PRIOR ART

Numerous designs for liquid adhesive and solution applying devices have been provided in the prior art. Even though these designs may be suitable for the specific individual purposes to which they address, they would not be suitable for the purposes of the present version of the invention as such designs are relatively cumbersome and elaborate in design and construction and do not afford the precise control of adhesive and solution application of the instant invention. These designs are exemplified by U.S. Pat. No. 4,150,904, Roller Applicator With Pressure Responsive Valve, issued to Stewart on 24 Apr. 1979.

As such, it may be appreciated that there is a continuing need for a new and improved applicator device or pen with means to apply liquid adhesive or solution in a precise and confined manner. In these respects, the present version of the invention substantially departs from the conventional concepts and designs of the prior art, and in so doing provides an apparatus that substantially fulfills this need. Additionally, the prior patents and commercial techniques do not suggest the present inventive combination of component elements arranged and configured as disclosed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY

The present version of the invention, which will be described in greater detail hereinafter, relates to the field of devices that store and dispense liquid solutions and adhesives for sealing a variety of items. More specifically, this version of the invention is concerned with an applicator device or pen fabricated into the shape of a conventional writing pen, said device or pen designed to store and dispense liquid solutions and adhesives from a roller ball as the applicator device or pen is used in the manner of a writing pen. My version of the invention overcomes all of the shortcomings listed previously, in addition to novel aspects that will be described in detail hereinafter.

Described briefly, according to a typical embodiment, the invention presents an applicator pen for storing and dispensing in a precise and controlled manner liquid adhesive or solution onto the surface of a package, envelope, stamp, and the like. The pen, which is comprised of a cylindrical container and a container cover with pocket clip, is similar in shape and construction to that of a felt-tipped pen or marker. The cylindrical container is hollow and is fabricated at a first or lower end with a tapered tip and a second or upper end with a rounded top. An absorbent roller ball is maintained in rotating engagement within an aperture of the tapered tip. The cylindrical container encloses an internal cavity and reservoir of liquid adhesive or other solution that communicates through a lower aperture with the roller ball. As such, liquid adhesive or solution stored therein makes continual contact with the roller ball as it is rotated within the aperture of the tip for dispensation or application of the adhesive or solution onto a surface.

A first aperture is formed within the sidewall of the cylindrical container at the junction of the majority portion of the container with the tapered tip, and a second aperture is formed within the sidewall at the medial area thereof. The first aperture functions as a drain, and the second aperture as an opening to prevent the formation of a vacuum as the liquid adhesive or solution is dispensed from the internal cavity or reservoir.

The cylindrical container and cover are manufactured of material that is lightweight, durable, impervious to passage of liquid or air, and economical to acquire and manufacture, such as various plastics and the like. The material may also be opaque, translucent, transparent, or a combination thereof.

My invention, therefore, resides not in any one of these features per se, but rather in the particular combination of all of them herein disclosed. It is distinguished from the prior art in this particular combination of all of its structures for the functions specified.

In order that the detailed description of the invention may be better understood and that the present contribution to the art can be more fully appreciated, additional features of the invention will be described hereinafter. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application nor is it intended to be limiting as to the scope of the invention in any way.

Accordingly, it is an object of my version of the invention to provide a low-cost, easy-to-manufacture, and easy-to-market applicator pen.

A further object of my version of the invention is to provide an easy-to-use and versatile applicator pen.

A significant object of the invention is to provide an applicator pen fabricated as a hand-held pen or marker and comprising a cylindrical container and a container cover with pocket clip, said cylindrical container enclosing an internal cavity and reservoir of liquid adhesive or solution that communicates with an absorbent roller ball.

A final but very significant object of the invention is to provide an applicator pen that dispenses liquid adhesive or solution onto a variety of surfaces, such as envelopes, containers, packages, and stamps in a precise and controlled manner.

For a better understanding of the invention, its operating advantages and the specific objects attained by its uses, reference should be made to the accompanying drawings and descriptive matter in which there is illustrated a preferred embodiment of the invention. The foregoing has outlined some of the more pertinent objects of the invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the intention and the detailed description of the preferred embodiment in addition to the scope of the invention illustrated by the accompanying drawings.

BRIEF DESCRIPTION OF THE DRAWINGS

The foregoing and other objects, features and advantages of the invention will become more fully understood from the following description of the preferred embodiment of the invention as illustrated in the accompanying drawings in which like reference characters refer to the same parts throughout different views. The drawings are not necessarily to scale, emphasis instead being placed upon illustrating the principles of the invention.

DRAWING REFERENCE NUMERALS

10 Applicator Pen
12 Cylindrical Container
14 Container Cover
16 Cover Body
18 Opened End
20 Closed End
22 Pocket Clip
24 Tapered Tip
26 Roller Ball
28 Aperture
30 Aperture
32 Main Cavity
34 Cavity Tip
36 Aperture
38 Solution
40 Container Top

DESCRIPTION OF THE PREFERRED EMBODIMENT

Description

Figure 1:
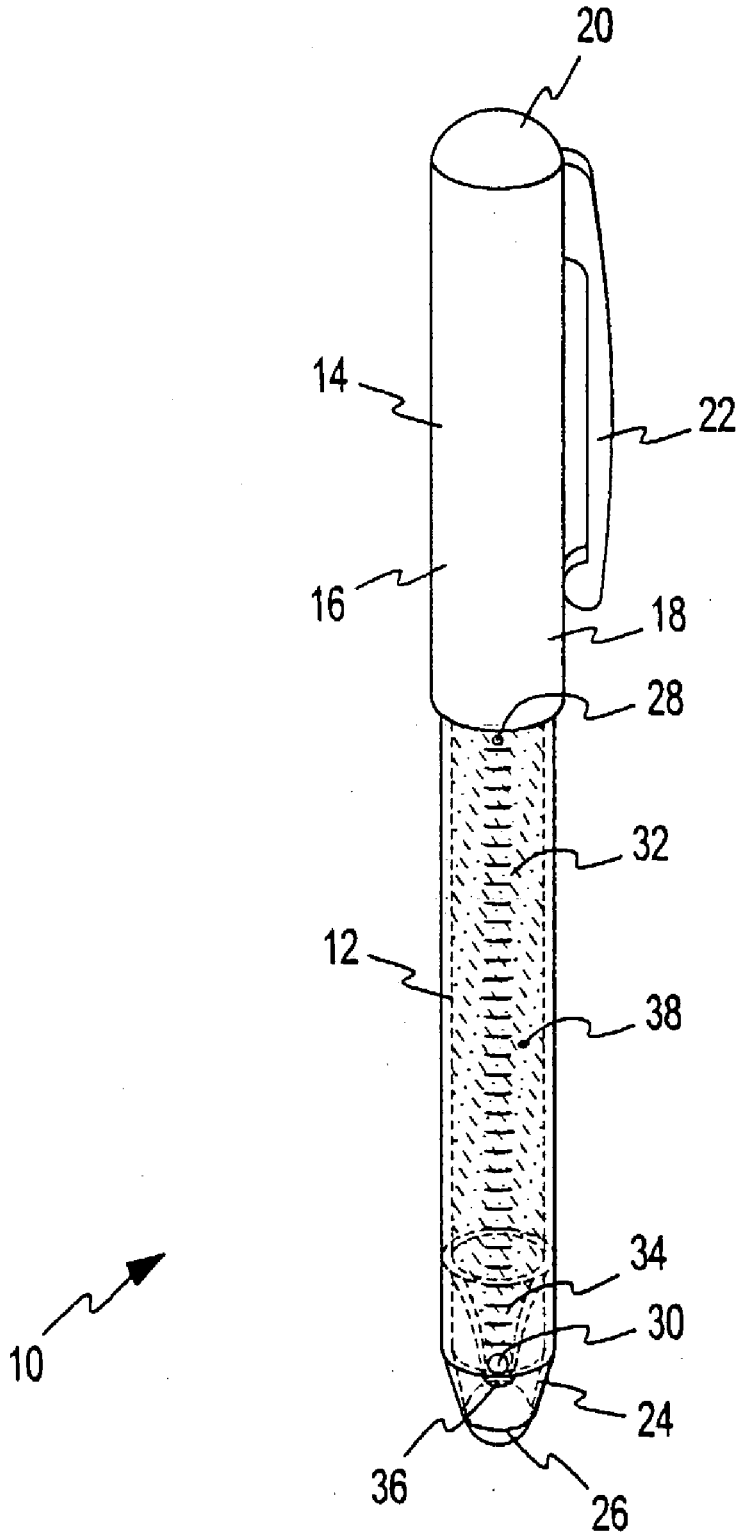
FIG. 1 is a perspective view of an applicator pen in accordance with the present version of the invention.

Referring now to the drawings and, in particular, to FIG. 1 wherein there is illustrated a typical embodiment of the applicator pen 10. The present version of the invention 10 consists of a transparent cylindrical container 12 and a container cover 14, which is attached to the top portion of the container 12 in frictional engagement. The cover 14 is comprised of a cylindrical-shaped, hollow cover body 16, opened end 18 defining an aperture, closed end 20, and pocket clip 22. The cylindrical container 12 and cover 14 are fabricated as integral devices of plastic, hard rubber, and the like using conventional injection molding techniques. Additionally, the container 12 and cover 14 may be provided in a variety of tints, shades, and hues incorporating a range of opacity, translucence, and transparency or a combination thereof. The cylindrical container 12 is comprised at a first or lower end of a tapered tip 24, which encloses an aperture. A roller ball 26 is disposed in rotating engagement within said aperture. A first aperture 28 is formed within the sidewall of the container 12 at the medial section thereof, and a second aperture 30 is formed within the sidewall of the container 12 at the junction with the tapered tip 24. The container 12 encloses an internal cavity or reservoir that is comprised of a main cavity 32 and a cavity tip 34, said tip 34 communicating with the roller ball 26. The lower end of the cavity tip 34 encloses an aperture 36, which allows liquid adhesive or solution 38 stored within the main cavity 32 and cavity tip 34 to make contact with the roller ball 26 and be transferred onto a surface requiring adhesion or sealing as the roller ball 26 rotates within the aperture 36 over said surface. The cylindrical container 12 thus functions as an implement to be grasped and manipulated by the hand of a user, to store or house a reservoir of liquid adhesive or solution 38, and to apply or dispense said adhesive or solution 38.

As the liquid adhesive or solution 38 is dispensed from the cavity 32, 34, air is drawn through the first aperture 28 in order to prevent a vacuum from occurring within the cavity 32, 34, which would inhibit further dispensation of the solution 38. When necessary, excessive or unused adhesive or solution 38 can be drained from the second aperture 30.

Figure 2:
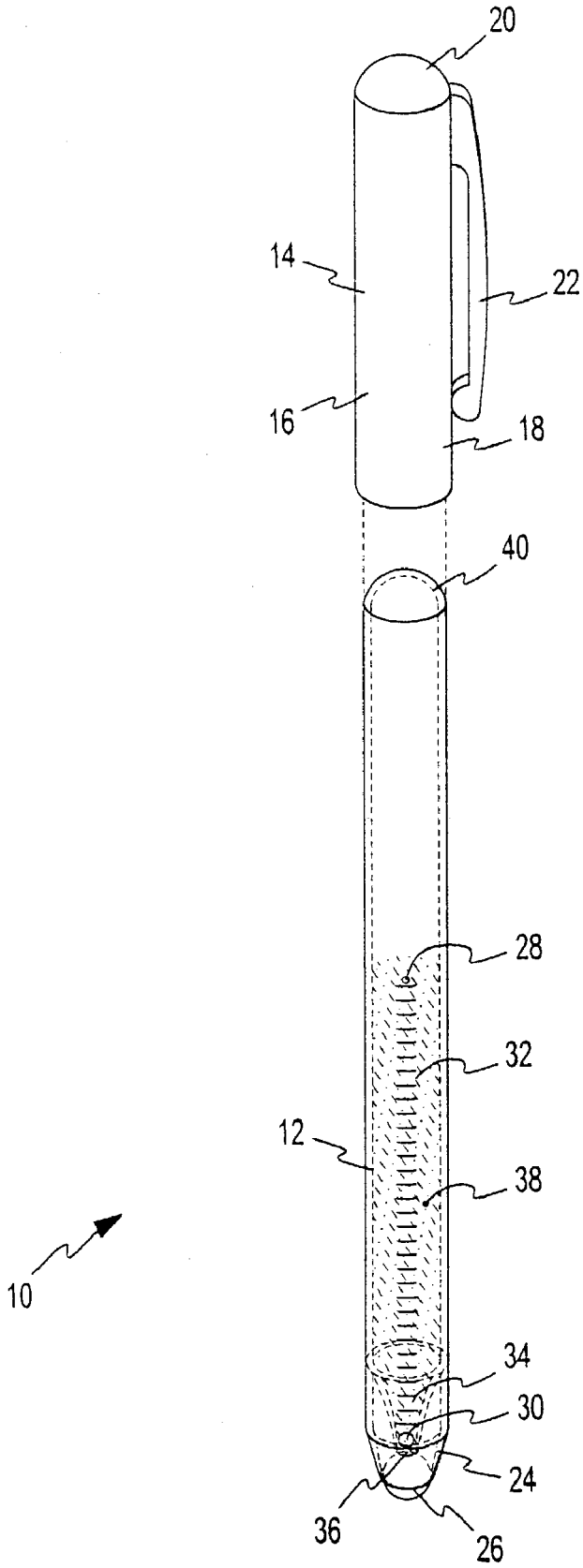
FIG. 2 is a perspective view of an applicator pen with a cover removed from the container portion of said applicator pen.

Referring to FIG. 2, therein illustrated is the applicator pen 10 with the container cover 14 separated from the cylindrical container 12. During non-use, the cover 14 can be fitted in frictional engagement over the lower end of the container 12 to cover the tapered tip 24 and roller ball 26 in order to prevent said ball 26 from collecting dirt, becoming damaged, or drying out.

While this version of the invention has been illustrated and described in detail in the drawings and foregoing description, the same is to be considered as illustrative and not restrictive in character, it being understood that only the preferred embodiment has been shown and described and that all changes and modifications that come within the spirit of the version of the invention are desired to be protected. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

CONCLUSION AND SCOPE OF INVENTION

From the foregoing, it will be understood by persons skilled in the art that an improved applicator pen for dispensing liquid adhesive or solution onto the surface of a container, envelope, package, stamp, and the like has been provided. The invention is relatively simple and easy to manufacture, yet affords a variety of uses. While my description contains many specificities, these should not be construed as limitations on the scope of the version of the invention, but rather as an exemplification of the preferred embodiment thereof. The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention. Although this invention has been described in its preferred form with a certain degree of particularity, it is understood that the present disclosure of the preferred form has been made only by way of example and numerous changes in the details of construction and combination and arrangement of parts may be resorted to without departing from the spirit and scope of the invention.

What is claimed is:

1. A hand-held applicator pen for applying a liquid solution comprising:

a container having a cylindrical side wall with a main cavity having liquid solution therein, a tapered tip at a lower end of said container, a roller ball positioned within said tapered tip and in communication with said solution for dispensing said solution wherein said solution can flow through an aperture in an end of said container and onto said ball such that said ball can apply said solution onto a surface.

a first aperture in said sidewall and spaced from said lower end of said container for venting said container during use, and a second aperture positioned in the sidewall at the junction of said container and said tapered tip for draining excessive or unused solution to an exterior of said container.

2. A device as defined in claim 1 wherein said container is made from a material which is opaque, translucent, transparent or a combination thereof.

3. A device as defined in claim 1 and further including a cover for covering said roller ball when not in use.

* * * * *